United States Patent [19]

Kestner

[11] 4,338,359

[45] Jul. 6, 1982

[54] METHOD OF FACILITATING LOW TEMPERATURE DISCHARGE FROM A CONTAINER OF PARTICULATE MATERIAL

[75] Inventor: Mark O. Kestner, Mendham, N.J.

[73] Assignee: Apollo Technologies, Inc., Whippany, N.J.

[21] Appl. No.: 243,752

[22] Filed: Mar. 16, 1981

[51] Int. Cl.[3] ..... B05D 7/22; B05D 5/08

[52] U.S. Cl. ..... 427/230; 427/239

[58] Field of Search ..... 427/230, 239

[56] References Cited

U.S. PATENT DOCUMENTS

| | | |
|---|---|---|
| 2,101,472 | 12/1937 | Kormann . |
| 2,116,682 | 5/1938 | Kleinicke et al. . |
| 2,238,776 | 4/1941 | Kleinicke . |
| 2,250,287 | 7/1941 | Work et al. . |
| 2,346,891 | 4/1944 | Adlington . |
| 2,373,727 | 4/1945 | West et al. . |
| 2,436,146 | 2/1948 | Kleinicke . |
| 2,812,264 | 11/1957 | Goms . |
| 3,096,290 | 7/1963 | Duane et al. . |
| 3,711,409 | 1/1973 | Ayres et al. . |
| 3,763,071 | 10/1973 | Katzer et al. . |
| 3,849,361 | 11/1974 | Zweigle . |
| 3,865,619 | 2/1975 | Pennewiss et al. . |
| 3,940,356 | 2/1976 | Byrnes . |

*Primary Examiner*—James R. Hoffman

*Attorney, Agent, or Firm*—James and Franklin

[57] ABSTRACT

Low temperature discharge of particulate material from a hopper or the like is facilitated by coating the hopper walls with a water solution of an inorganic freeze point depressant, the solution having a freezing point below about −20° C. and being thickened by the addition thereto of a compatible thickening agent, whereby the substance can be readily applied to the wall and will remain in position on the wall. When the substance is to be used to coat steel or aluminum walls the pH of the substance is modified if necessary to prevent corrosion of the wall without adversely affecting the viscosity of the substance.

11 Claims, No Drawings

METHOD OF FACILITATING LOW TEMPERATURE DISCHARGE FROM A CONTAINER OF PARTICULATE MATERIAL

BACKGROUND OF THE INVENTION

The present invention is directed to facilitating the unloading of coal or other substances present in the form of particles from containers such as hoppers when the unloading takes place at sub-freezing temperatures. In particular, the invention is directed to the prevention or minimization of the tendency of the particles of coal or other material to freeze to the sides of the container and thus resist even the most strenuous unloading efforts.

Many materials present in the form of particles, such as coal, are stored in containers from which they ultimately must be removed. For example, coal is transported by rail or barge, and when thus transported is carried within containers, often open-topped, from which the coal is ultimately removed, often by gravity flow through the openable bottom of the hopper-like container. Any difficulty in readily effecting the complete removal of the coal from the container represents a significant economic problem, both because of the time and trouble involved in overcoming impediments to such removal and because of the economic loss that results in the event that some of the coal is not removed from the container. The latter disadvantage is particularly important when transportation is involved; it costs money to move a given weight of coal from one place to another, and if some of the coal thus moved remains in the rail car at the point of desired removal the cost of transportating it to that point is a dead waste. Hence it is important that all possible steps be taken to provide for efficient complete removal of such transported materials from their containers at the points of delivery thereof.

Removal of particles such as coal from their containers becomes particularly troublesome at below-freezing temperatures. The coal is usually exposed to the elements by being stored in open piles before it is placed in rail cars or barges, and even when the coal is being transported it is usually exposed to the elements because the rail cars and barges are generally open-topped. Hence rain and snow have direct access to the coal particles, and when the weather is cold the particles tend to freeze to one another. (The term "particles" is here used in a broad sense, including tiny, small and relatively large pieces over the entire range in which coal and other water-insoluble products exist.) This problem is exacerbated by the fact that the coal particles are usually porous, water is absorbed by the particles, and it then can migrate to the surfaces of the particles, there to freeze when the temperature is low enough, thus bonding the particles to one another in bulk. Hence the rate and extent of the freezing of coal particles depends upon the surface and absorbed moisture of the coal, the size distribution of coal particles, and the weather conditions which prevail during transportation of the material.

In the past a variety of chemical formulations have been developed to minimize or prevent the bulk freezing of coal. The materials, generally known as freeze conditioners, contain substances which weaken ice crystals and reduce the compressive strength of the frozen particulate mass. Use of these freeze conditioners therefore facilitates the unloading of coal at or below freezing temperatures.

There is an additional problem, however, which those prior art freeze conditioners has not significantly ameliorated. Not only does the coal freeze in bulk, as described above, but it also tends to freeze to the sides of the container, usually metal walls formed of steel or aluminum. This freezing occurs because the moisture present at or migrating to the surface of the coal particles touches the container walls, which are usually colder than the bulk material, and the water or water vapor there forms ice crystals which bind coal particles to the metal container surfaces as well as to themselves. Bulk freeze conditioning agents have little effect on the freezing of coal to container walls, and deposits, sometimes relatively massive, of frozen coal often adhere to container surfaces in spite of bulk freeze conditioning treatment. To remove these deposits requires thawing by thermal or chemical means or physical dislodging by mechanical devices like vibrators or air cannons. In the event, not unusual, that the deposits on the rail car walls cannot be dislodged by any of these means, those deposits are carried back to the loading point. To the extent that chemical or mechanical means are attempted to dislodge the side-freezing deposits, the costs of the unloading operation are increased, and to the extent that the deposits are not dislodged the capacity of the container for subsequent shipments is decreased, another economic loss.

This problem of frozen deposits on the container sides has long been recognized, and various attempts have been made to prevent the formation of such deposits, usually by coating the wall surfaces with a substance thought to be effective. Some such substances have been a liquid mold-release agent, like petroleum or silicone oils, while other substances have comprised a solid adherent film of plastic. However, these approaches have not been reliably effective.

The liquid mold-release agents have been found to be generally ineffective, principally due to the fact that such materials are water immiscible and cannot uniformly coat a cold metal surface already containing absorbed layers of water or ice crystals. Plastic coatings like epoxies, urethanes or Teflons have also been found to be ineffective in spite of their high degree of water repellency because a mechanical bonding of ice to the coated surface still occurs to an appreciable degree.

In this regard it must be borne in mind that as a practical matter substances used to coat the container walls will be applied to those walls at low temperatures, usually below freezing. When a rail car comes to its loading point the coating will be applied to the inner surfaces of its walls before the coal is put into the car. If the temperature is below freezing, as will usually be the case, the container walls will be at a below freezing temperature when the coating is applied thereto. Since the rail car has been exposed to the elements on its trip to the loading point and during its stay at the loading point, it is most likely that the inner surfaces of its walls will be already wholly or partially covered with ice or frost. The material used for coating the wall therefore must be capable of adhering to the wall even if the wall is covered with frost or ice, and the coating must be effective to prevent moisture-containing coal particles from becoming ice-bound to the ice or frost on the inside of the container wall.

It will be further appreciated that some significant period of time may elapse between the coating of the container walls and the loading of the container with the coal. It therefore is necessary that the coating, when once applied, will tend to remain in place for that appreciable length of time, because if it runs down from the walls before the coal is loaded its effect will be lost. Moreover, after the coal is loaded, the coating must also tend to remain in place for an extended period of time, such as that involved in transporting the coal to its point of delivery, a particularly troublesome problem because the container will be subjected to a great deal of vibration in the course of transportation.

I have discovered that the low temperature discharge of particulate material from a container having a wall with which said material makes contact and along which said material moves when being discharged from said container is greatly facilitated, and the freezing of that particulate material to the container walls is either prevented or greatly minimized, by coating the walls with a water solution of an inorganic freeze point depressant present in an amount such that the solution has a freezing point below about −20° C., which solution also contains a thickening agent compatible with the freeze point depressant and effective to render the solution approxiately thick and viscous, so that while it is not so viscous that it cannot readily be applied to the wall, when once applied thereto it will tend to form a relatively thick coating, preferably 1/16" or more thick, which will remain in place both during the coal loading operation and the coal transporting operation. Because this substance is water-miscible, thereby differentiating itself from the water immiscible liquid mold-release agents previously proposed for this purpose, it effectively coats and stays in place on cold metal surfaces even if those surfaces already carry coatings of water or ice crystals.

The inorganic freeze point depressants used in accordance with the present invention must be water soluble, must be effective to depress the freezing point of the water into which they are dissolved, and must be of a nature such as not to tend unduly to corrode the material, usually aluminum or steel, of which the container walls are formed. Obviously those inorganic salts which provide for maximized freezing point depression per amount of salt dissolved would be preferred, all other things being equal, but cost considerations also loom large. As at present advised, calcium chloride is a preferred substance, as is magnesium chloride, while ammonium chloride, sodium chloride, sodium nitrate, and ammonium nitrate are also desirable from functional and economic points of view. The inorganic substance is present in the solution in an amount sufficient to depress the freezing point of that solution an appreciable degree, about −20° C. being probably the minimum freeze point depression from a commercial point of view. Among the substances mentioned, magnesium chloride, ammonium chloride and sodium chloride all produce greater freeze point depression per amount of material employed than does calcium chloride, but calcium chloride is, as indicated, believed to be the preferred material on a cost/performance basis. Solutions of calcium chloride and water at concentrations ranging from 20 to 60% by weight appear to be suitable. A 27% solution of anhydrous calcium chloride in water, for example, possesses a freezing point of −34.9° C. A 38 to 50% solution of calcium chloride is preferred because of its extremely low freezing point and commercial availability.

A wide variety of different thickening (or gelling) agents can be used, either alone or in combination, to thicken the above-described water solutions. This thickening is necessary, because if the water solutions were applied in unmodified form to container walls they would simply run down the walls and become dissipated. The particular thickening agent employed should, however, be compatible with the particular salt that is employed as the freeze point depressing agent. For example, when the freeze point depressant agent is calcium chloride, acrylic polymers and starches, often used as thickening agents, appear not to be particularly desirable. Among the thickening agents that do appear to be effective, compatible and economically feasible are hydroxyethyl, hydroxypropyl, carboxymethyl and methyl cellulose derivatives, xanthan and polysaccharide gums, alginates, polycarboxylate salts, copolymers of vinyl ethers and maleic anhydride, and mixtures thereof, but it will be understood that other equivalent thickening or gelling agents could be employed. The hydroxyethyl cellulose derivative sold by Union Carbide Co. under the tradename "Cellosize" has been found to be quite effective.

The actual amount of thickening or gelling agent employed will depend upon the particular substance involved, but as a general rule it appears that the range of thickener concentrations is between 0.01 to 10% by weight, limited at the lower end by the appearance of an adequate thickening effect and at the upper end by economic and/or solubility considerations, and the presence of sufficient fluidity so that the substance can be readily applied to the container walls. Within that maximum range, the preferred range is 0.1 to 5%, and the highly preferred range is 0.2 to 1%, based upon present experience. For the Union Carbide Cellosize product Model QP-4400H, the maxium concentration range is 0.01 to 2%, the preferred concentration range is 0.1 to 1%, and the highly preferred range is 0.3 to 0.6%, all by weight.

Because the particular value of thickener concentration is so largely dependent on the particular thickener employed, and because of the wide range of thickener substances which can be employed, the amount of thickener employed can perhaps best be specified in terms of the viscosity produced thereby, as set forth in the following table:

TABLE I

| | Viscosity Range, centipoise | |
|---|---|---|
| Range | 70° F. | 0° F. |
| Maximum | 50–1500 | 500–20,000 |
| Preferred | 100–1000 | 1000–10,000 |
| Highly Preferred | 400–700 | 3000–6000 |

The maximum range at 0° F. is limited at the lower end by the onset of resistance to flow on a vertical surface and at the upper end by the abilities of the application equipment.

The pH of the coating substance is also a factor to be considered, largely because the tendency of the dissolved inorganic salt to corrode the steel or aluminum of which the container walls are generally formed, if present, will vary with the pH of the coating. For example, corrosion tests indicate that aluminum is severely corroded by the coating substances at pH 9, that corrosion is at a minimum at pH 7 and that corrosion rates were acceptable at pH 6 or 8. For steel, corrosion was at a minimum at pH 8 and acceptable at pH 6, 7 or 9.

The optimum pH range of the generalized product was therefore taken to be 6.0 to 7.5 when both steel and aluminum walled containers might be encountered in practise. A 30% calcium chloride solution normally has a pH of about 9.3. Hydrochloric acid was added to the coating composition to bring its pH within the desired range. Other buffering substances may be employed, but the effects of each must be carefully weighted before adoption. For example, when ammonium chloride was used to reduce the pH of a calcium chloride solution, it made a pH 7 solution corrosive to aluminum, but it slightly inhibited corrosion of steel.

The pH of the system often also affects viscosity, to a degree and in a manner usually differing as between different thickening substances, and that, too, is a factor which must be taken into consideration in determining whether a given thickener is compatible.

Treatment rates for the application of the coating substances to wall surfaces range from approximately 2 to 10 gallons per 500 square feet of surface area. The lower limit is the minimum amount of material required to coat the surface while the upper limit is the maximum amount of material that can be applied without drainage or dripping. It is preferred that coatings having a thickness of at least 1/16" be applied to the walls.

The coating material may be applied in any desired fashion, but spraying through an appropriate pump and nozzle system is preferred. A typical spray rate is a half a gallon per minute at a pressure of 60 pounds per square inch, but this is exemplary only. Twelve gallons of coating material may be used per rail car having 1500 square feet of wall surface, which will produce a coating layer having a thickness varying between 1/16" and ⅛".

A particular formulation which has given excellent results is as follows:

EXAMPLE 1

39.7% calcium chloride dihydrate
59.55% water
0.75% Cellosize QP-4400 hydroxyethyl cellulose Two test methods were used to evaluate performance. The first method consists of coating the interior of a one gallon steel bucket with product and placing 10 lbs. of coal in this container. The additive was applied to a cold metal surface and the entire test procedure was carried out within the confines of a large freezer compartment. The bucket and its contents were cooled to a subfreezing temperature over a specified period of time and then inverted. The time required for the mass of coal to fall was compared to a control bucket whose interior surfaces were not treated and taken as a relative measure of product performance. The Carbowax, silicone, glycol, fuel oil, asphalt, and Repello DC are prior art bulk freeze conditioners. Examples of the results of these tests are listed in Table I.

TABLE II

| | | BUCKET DROP TESTS* | | | | |
|---|---|---|---|---|---|---|
| TEST NO. | ADDITIVE | TREATMENT RATE (GAL./CAR EQV.) | SURFACE MOISTURE % | FINES ¼" % | DROP TIME (MINUTES) | TEST TEMPERATURE °F. |
| 1 | NONE | — | 10 | 70 | >60 | 20 |
| 2 | EXAMPLE 1 | 6 | 10 | 70 | 36 | 20 |
| 3 | EXAMPLE 1 | 12 | 10 | 70 | 9 | 20 |
| 4 | EXAMPLE 1 | 30 | 10 | 70 | 0 | 20 |
| 5 | CARBOWAX | 15 | 10 | 70 | 18 | 20 |
| 6 | SILICONE | 10 | 10 | 70 | 15 | 20 |
| 7 | GLYCOL (PROPYLENE) | 7 | 10 | 70 | >60 | 20 |
| 8 | FUEL OIL (No. 2) | 6 | 10 | 70 | >60 | 20 |
| 9 | ASPHALT | 22 | 10 | 70 | >60 | 20 |
| 10 | REPELLO DC | 14 | 10 | 70 | 43 | 20 |

*2 × 0 BITUMINOUS COAL

The second method involved the use of a large 700 lb. capacity test bin modeled to simulate a bottom drop railway car in that it contains a 45° slope and hopper doors. The interior surfaces were coated with product, the bin loaded with coal and frozen for a specified period of time. The hopper doors were opened and the amount of coal flowing from the bin was taken as a measure of relative performance as against an untreated control. Examples of the results of these tests are listed in Table III.

TABLE III

| | | | | SIDE RELEASE AGENT TEST RESULTS | | | | | | | | |
|---|---|---|---|---|---|---|---|---|---|---|---|---|
| Test No. | Product | Treatment S.M. | % Fines | % ¼" (°F.) | Test Temp sure | Time Expo- Retained | % Initially w/raps | % Ret. S.T. | (°F.) (°F.) | 2" (°F.) | Center Coal | Areas of Resid. |
| 1 | None | None | 7.9 | 70 | 20 | 14 hr. | 94 | 30 | 24 | 45 | 45 | Bulk-slope |
| 2 | None | None | 4.0 | 70 | 0 | 14 hr. | 97 | 30 | 12 | 18 | 38 | Bulk-slope |
| 3 | Example 1 | 12 gal/car | 8.0 | 69 | 20 | 14 hr. | 8 | 0 | 24 | 33 | 45 | Slope |
| 4 | Example 1 | 12 gal/car | 8.0 | 69 | 20 | 14 hr. | 2 | 0 | 24 | 32 | 46 | None |
| 5 | Example 1 | 12 gal/car | 4.0 | 70 | 0 | 14 hr. | 0 | 0 | 12 | 18 | 38 | None |

Comments
1 64% Rel. at 2 raps; 1" on doors
2 Severe Ratholing 1" on doors
3 1 rap disch 8%
4 2% on upper corner
5 Clean

EXAMPLE 2

A 30% water solution of magnesium chloride was thickened with Cellosize QP 4400 to a viscosity of 530–540 at 70° F. and a viscosity of 3000–3400 at 0° F., with a pH of 6.03. Tests showed this formulation to be of the same order of effectiveness as that of Example 1.

Table IV shows the results of tests carried out on an eastern 1×0 bituminous coal with 78% <¼" fines in the simulated rail car-hopper container. Examples 5 and 6 differ from Examples 3 and 4 respectively in that in Examples 5 and 6 the coal was treated with a bulk freeze conditioner. Note that in Example 2 the side release agent of the present invention functioned properly, even though there was excessive bulk freezing of the coal mass.

TABLE IV

| Test No. | Product | Treatment Rate | % S.M. | % ¼" Fines | Test Temp (°F.) | Time Exposure | % Initially Retained | % Ret. w/raps | (°F.) S.T. | 2" (°F.) | Center (°F.) | Areas of Resid. Coal |
|---|---|---|---|---|---|---|---|---|---|---|---|---|
| 1 | Baseline | None | 8.0 | 78 | 0 | 14 hr. | 85 | 75 | 12 | 18 | 36 | Bulk |
| 2 | Baseline | None | 8.0 | 78 | 0 | 14 hr. | 85 | 80 | 12 | 17 | 35 | Bulk |
| 3 | Example 1 | 1 gal/150ft$^2$ | 8.0 | 78 | 0 | 14 hr. | 80 | 0 | 12 | 18 | 37 | Bulk |
| 4 | Example 2 | 1 gal/150ft$^2$ | 8.0 | 78 | 0 | 14 hr. | 75 | 60 | 12 | 17 | 36 | Bulk |
| 5 | Example 1 plus bulk freeze point conditioner | 1 gal/150ft$^2$ 2pt/ton | 8.0 | 78 | 0 | 14 hr. | 0 | 0 | 13 | 18 | 37 | None |
| 6 | Example 2 plus bulk freeze point conditioner | 1 gal/150ft$^2$ 2pt/ton | 8.0 | 78 | 0 | 14 hr. | 20 | 0 | 12 | 18 | 37 | Slope |

Comments
1 Slope & walls did not release
2 Slope & walls did not release
3 Entire bulk slid & broke-up at 8 raps
4 Bulk slid down, but not out
5 Clean
6 Slope released w/1 rap
Legend:
S.M. = Surface Moisture;
Ret. W/Rap = 20 raps of release bar;
S.T. = Surface Temperature on inside metal surface;
Test Car Capacity - 750 lbs. with 25 ft$^2$ Treatment of the coal with a bulk freeze conditioner, as might be expected, facilitates the flow of coal out through the hopper door when the door is opened, but, as has been pointed out, the use of such a bulk conditioner does not materially minimize the freezing of coal to the container sides. When used in conjunction with the side release agent of the present invention, however, the bulk-treated coal, both the central portion thereof and the portion thereof close to the container sides, will flow from the hopper more readily than if the bulk conditioner were not used, as is shown by comparing Examples 5 and 6 with Examples 3 and 4 in Table IV.

It will be appreciated from the above that by using an appropriately thickened or gelled water solution of an inorganic freeze point depressant a release coating is formed on the container walls even when those container walls are at a below freezing temperature and even when they are initially coated in whole or in part with water, frost or ice. The release coating of the present invention reliably stays in place when the coal is loaded and when the coal is transported, and it effectively prevents the existence or buildup of coal frozen to the container sides. Hence unloading of containers for coal and the like at low temperatures is greatly facilitated.

While this invention has been here described primarily in connection with the loading, transportation and unloading of coal of widely varying particle sizes, it is also applicable for use in connection with the unloading of other water-insoluble materials in particle form, the particle sizes also varying widely.

While but a limited number of embodiments of the present invention have been here specifically disclosed, it will be apparent that many variations may be made therein, all within the scope of the invention as defined in the following claims.

I claim:

1. The method of facilitating low temperature discharge of particulate material from a container having a wall with which said material makes contact and along which said material moves when being discharged from said container, which method comprises:

(a) applying to said wall an adherent coating comprising a water solution of (i) an inorganic freeze point depressant, said solution having a freezing point below about −20° C., and (ii) a thickening agent which is substantially compatible with said inorganic freeze point depressant and is present in an amount sufficient to produce in said solution a viscosity range in centipoise between about 50 and 1,500 at 70° F. and between about 500 and 20,000 at 0° F., (b) putting said material into said container to make contact with said wall, and (c) when desired, discharging said material from said container, in the course of which said material moves along said wall.

2. The method of claim 1, in which said vicosity range is between about 100 and 1,000 at 70° F. and between about 1,000 and 10,000 at 0° F.

3. The method of claim 1, in which said viscosity range is between about 400 and 700 at 70° F. and between about 3,000 and 6,000 at 0° F.

4. The method of any of claims 1–3, in which said inorganic freeze point depressant is a member of the group consisting of calcium chloride, magnesium chloride, ammonium chloride, sodium chloride, sodium nitrate, ammonium nitrate and mixtures thereof.

5. The method of any of claims 1–3, in which said inorganic freeze point depressant comprises calcium chloride.

6. The method of any of claims 1–3, in which said inorganic freeze point depressant comprises magnesium chloride.

7. The method of any of claims 1–3, in which said thickening agent is a member of the group consisting of hydroxyethyl, hydroxypropyl, carboxymethyl and methyl cellulose derivatives, xanthan and polysaccharide gums, alginates, polyethylene oxides, polycarboxylic acids, polycarboxylate salts, and copolymers of vinyl ethers and maleic anhydride, and mixtures thereof.

8. The method of any of claims 1–3, in which said thickening agent is a hydroxyethyl cellulose derivative.

9. The method of any of claims 1–3, in which said wall is formed of aluminum and in which said coating has a pH between about 6 and 8.

10. The methods of any of claims 1–3 in which said wall is formed of steel and said coating has a pH between about 6 and 9.

11. The method of any of claims 1–3, in which said coating has a thickness of at least about 1/16".

* * * * *

Disclaimer and Dedication 4,338,359.—*Mark O. Kestner,* Mendham, N.J. METHOD OF FACILITATING LOW TEMPERATURE DISCHARGE FROM A CONTAINER OF PARTICULATE MATERIAL. Patent dated July 6, 1982. Disclaimer and Dedication filed June 13, 1983, by the assignee, *Economics Laboratory, Inc.*

Hereby disclaims and dedicates to the Public the entire remaining term of said patent.

[*Official Gazette August 16, 1983.*]